US006420690B1

(12) United States Patent
Kim

(10) Patent No.: US 6,420,690 B1
(45) Date of Patent: Jul. 16, 2002

(54) MICROWAVE OVEN HAVING A VENT GRILL FORMED AS PART OF A DOOR AND/ OR CONTROL PANEL

(75) Inventor: Su Hwan Kim, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/925,610

(22) Filed: Aug. 10, 2001

(30) Foreign Application Priority Data

Dec. 20, 2000 (KR) ..... 2000-79361

(51) Int. Cl.[7] ..... H05B 6/80

(52) U.S. Cl. ..... 219/757; 219/702; 219/739; 126/198; 126/21 A

(58) Field of Search ..... 219/757, 681, 219/739, 702; 126/198, 21 A, 299 R, 299 D

(56) References Cited

U.S. PATENT DOCUMENTS 4,184,945 A * 1/1980 Morgan et al. ..... 219/757

5,387,258 A * 2/1995 Puricelli ..... 126/21 A

FOREIGN PATENT DOCUMENTS

GB 2 013 872 * 8/1979 ..... 126/198
JP 2-72590 * 3/1990 ..... 219/739

* cited by examiner

*Primary Examiner*—Philip H. Leung
(74) *Attorney, Agent, or Firm*—Fleshner & Kim, LLP

(57) ABSTRACT

The present invention relates to a microwave oven. Though the present invention provides a system in a front surface thereof for air communication between inside and outside of the microwave oven, the number of components for the front surface is minimized. That is, vent grill parts 46 and 56 are formed as one unit with the door 40 and the control panel 50 of the microwave oven for covering vent holes 36 and 36' in the front surface 34 of a main frame 30 from external view. Top ends of the vent grill parts 46 and 56 are opened for permitting inside and outside of the microwave oven to be in communication through the vent holes 36 and 36'. There may be a louver 48 in the vent grill parts 46 and 56 in correspondence to the vent holes 36 and 36'.

21 Claims, 5 Drawing Sheets

MICROWAVE OVEN HAVING A VENT GRILL FORMED AS PART OF A DOOR AND/ OR CONTROL PANEL

BACKGROUND OF THE INVENTION

1. Field of the Invention

The present invention relates to a microwave oven, and more particularly, to a microwave oven in which a microwave is used for cooking food.

2. Background of the Related Art

The microwave oven is a cooker having a magnetron for generating, and directing a microwave to cooking material, to cause molecular movement therein, that generates a heat for the cooking material. Recently, a microwave oven is developed, which has a function of the cooker itself, as well as a function of ventilator that removes heat, gas, and smell for food from a gas range or gas oven range. Such a microwave oven is in general placed over the gas oven range, to call such a microwave oven as OTR (Over-the-Range) type microwave oven. An outer structure of the related art OTR type microwave oven will be explained with reference to FIGS. 1 and 2, briefly.

Referring to the drawings, a top and sides of the microwave oven is enclosed by an outer case 1. The outer case 1 has fastening holes 2 and 2' for coupling a vent grill 7 to be described below. The fastening holes 2 and 2' are provided with fastening screws 3, and 3' for fastening the vent grill 7 thereto. There is a door 4 in a front surface of the microwave oven for selective open/closing of a cooking chamber I inside of the microwave oven. The door 4 has a hand grip 4' for opening/closing the door. There is a control panel 5 on one side of the door 4. The control panel 5 is a part for conducting various operation of the microwave oven.

In the meantime, there is a long vent grill 7 in an upper part of the front surface of the microwave oven fitted in a lateral direction. In view of a hood combined with a microwave oven, the vent grill 7 provides ventilation between inside and outside of the microwave oven. The vent grill 7 is an inlet of air for cooling an electric fitting room, or air supplied into the cooking chamber, or an outlet of air discharged from inside to outside of the microwave oven.

There are fasting pieces 8 and 8' at both sides of a rear surface of the vent grill 7 each having a fastening hole 9 for screwing a screw 3 or 3'. The vent- grill 7 is in general injection molded, and-the fastening pieces 8 and 8' are not provided with a structure, such as boss, for fastening the fastening screws 3 and 3', due to an injection molding characteristic.

The vent grill 7 is position at upper part of the front surface of the related art microwave oven when the vent grill is fitted to the outer case 1, such that the fasting holes 9 in the fastening pieces 8 and 8' are matched to the fastening holes 2 and 2' on the outer case 1 for fixing the vent grill 7 to the outer case 1 by screwing the screws 3 and 3' through the outer case 1 and the fastening pieces 8 and 8'.

In the meantime, before the vent grill 7 is put on the upper part of the front surface of the microwave oven, clips (not shown) are inserted to the fastening pieces 8 and 8' on the vent grill 7.

However, the related art microwave oven has the following structural problems.

The pre-fitting of the clips to the fastening pieces 8 and 8' required for assembly of the vent grill 7 before the fastening screws 3 and 3' are screwed is a cumbersome work. The separate fabrication of the vent grill 7 with subsequent assembly to the upper part of the microwave oven requires a complicate management and assembly, and a high production cost. Moreover, the separate fabrication of the vent grill 7 with subsequent assembly to the upper part of the microwave oven causes gaps with the door 4 or the control panel 5 due to an assembly tolerance, or deformation during use of the microwave oven, that results in a poor outer appearance.

SUMMARY OF THE INVENTION

Accordingly, the present invention is directed to a microwave oven that substantially obviates one or more of the problems due to limitations and disadvantages of the related art.

An object of the present invention is to provide a microwave oven which requires no separate assembly of the vent grill and simplifying a front structure of the microwave oven.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the microwave oven includes a main frame both of a cooking chamber and an electric fitting room having a plurality of vent holes in an upper part of a front surface thereof, a door in the front surface of the main frame for opening/closing the cooking chamber selectively, a control panel in the front surface of the main frame in front of an electric fitting room, and a vent grill part formed as a unit with the door or the control panel so as to be spaced from vent holes in the front-surface even if the door is closed, for communicating air inside and outside of the microwave oven.

The vent grill part includes a louver at a position opposite to the vent holes in the upper part of the front surface of the main frame.

The foregoing microwave oven of the present invention minimizes the number of components, and gaps between components fitted in a front surface of the microwave oven.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention, In the drawings.

DESCRIPTION OF THE PREFERRED EMBODIMENT

Figure 1:
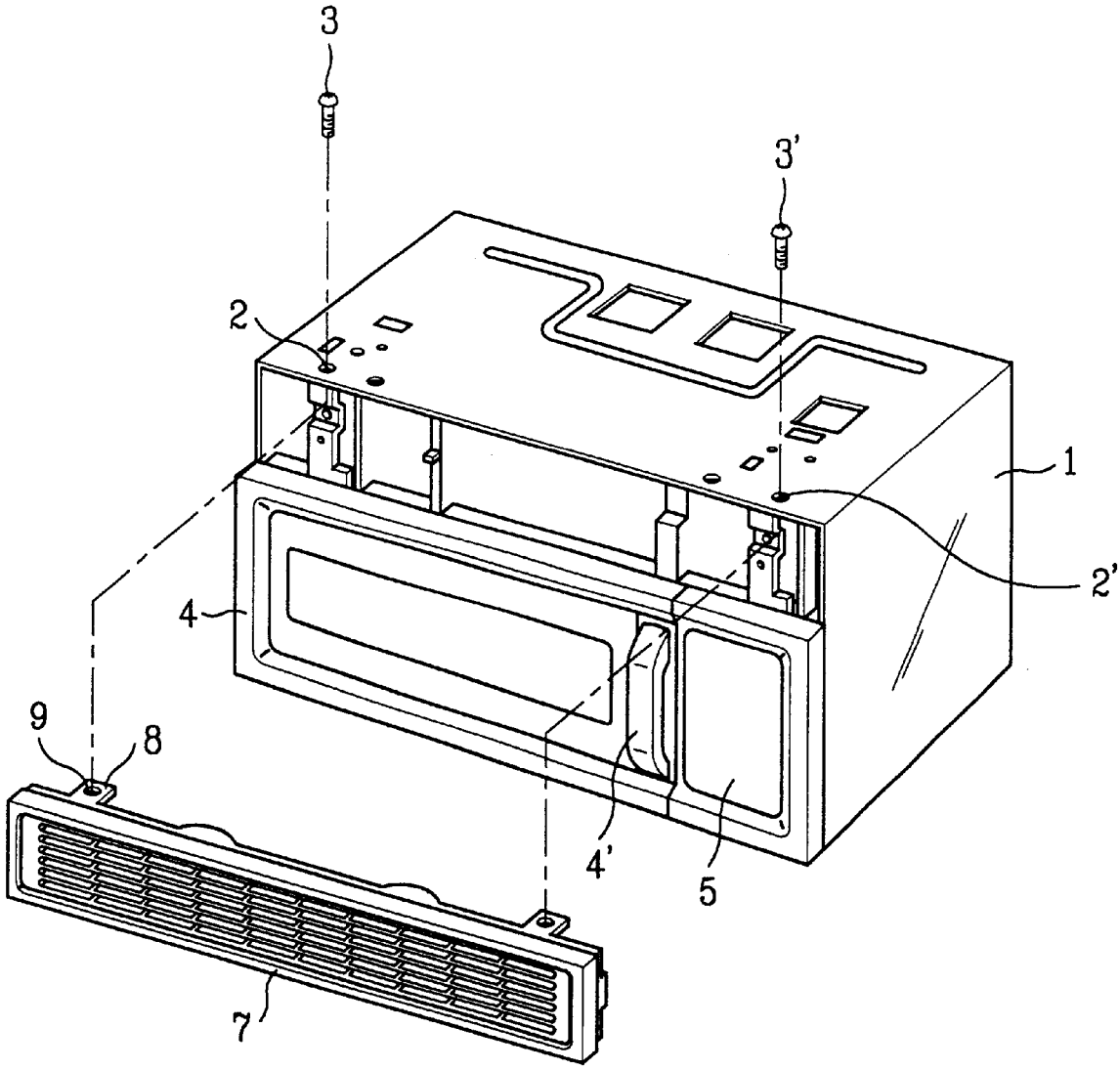
FIG. 1 Related Art
FIG. 1 illustrates a disassembled perspective view of an outer structure of a related art microwave oven.
Figure 2:
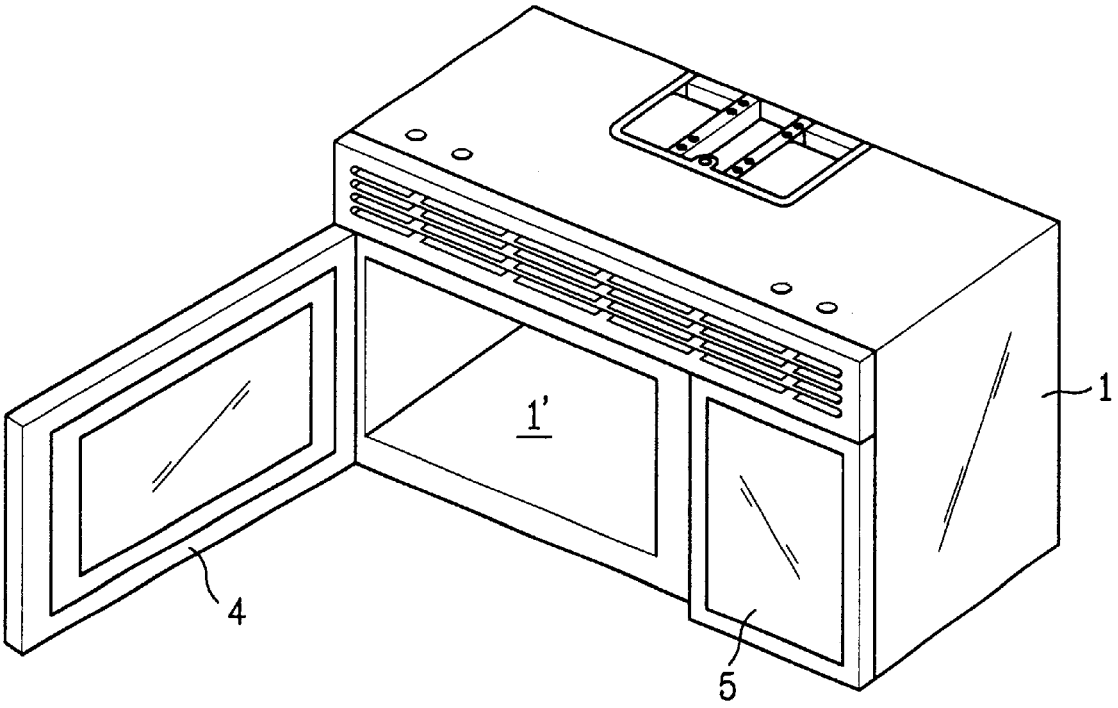
FIG. 2 Related Art
FIG. 2 illustrates a perspective view showing a state a door of a related art microwave oven is opened.
Figure 3:
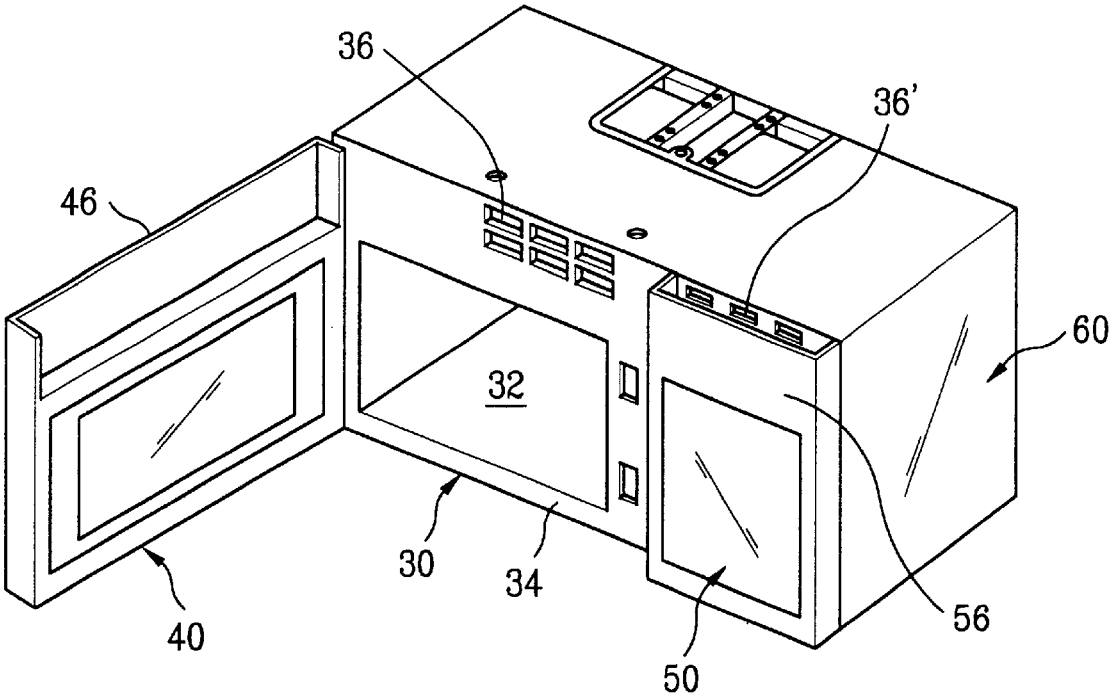
FIG. 3 illustrates a perspective view showing a state a door of a microwave oven in accordance with a preferred embodiment of the present invention is opened.
Figure 4:
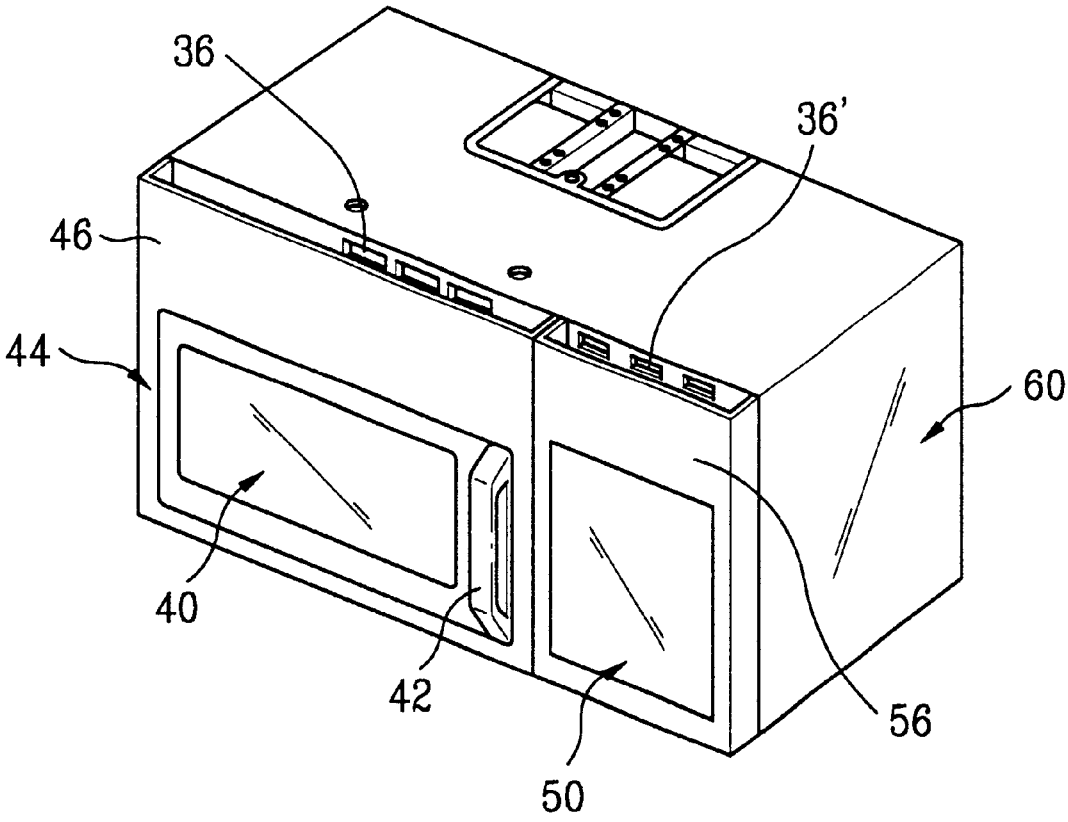
FIG. 4 illustrates a perspective view showing a state a door of a microwave oven in accordance with a preferred embodiment of the present invention is closed, and, FIG. 5 illustrates a section of key parts of a microwave oven in accordance with another preferred embodiment of the present invention.

Reference will now be made in detail to the preferred embodiments of the present invention, examples of which are illustrated in the accompanying drawings. FIGS. 3 and 4 illustrate a preferred embodiment of the present invention. As shown, there are a cooking chamber 32 for cooking food by a microwave and heat from a heater, and an electric fitting room in a main frame 30 of the microwave oven. An inlet of the cooking chamber 32 is opened in a front surface 34 of the main frame. There are a plurality of vent holes 36 and 36' in an upper part of the front surface 34 of the main frame for venting air. The plurality of vent holes 36 and 36' arranged in a matrix in the front surface 34 are provided for the cooking chamber and the electric fitting room. There is a door 40 in one side of the front surface 34 of the main frame 30 for opening/closing the cooking chamber 32, as a fore end of the door is rotated round a hinge (no shown) fitted at one end to permit the cooking chamber 32 to communicate with outside of microwave oven selectively, and there is a hand grip 42 on the fore end of the door at one side of the door 40. There is a door panel 44 around the door 40.

In the meantime, there is a vent grill part 46 formed as one unit with, and extended upward from a top end of, the door panel 44 for covering the vent holes 36 from user's vision. As best shown in FIG. 3, the vent grill part 46 is provided on the door panel 44. The vent grill part 46 has an upper part with reference to the vent holes 36 having a thickness smaller than a lower part thereof, to open the upper part. Accordingly, as shown in FIG. 4, when the door 40 is closed, air inside and outside of the microwave oven communicate through the vent holes 36 in the front surface 34 and an opened space in the upper part of the vent grill part 46.

In the meantime, there is a control panel 50 in one side of the cooking chamber 32 provided with various function buttons (not shown) for operating the microwave oven having a display part for indicating operation states of the microwave oven. There is an electric fitting room in rear of the control panel 50 having electric fittings for generating the microwave. There is a vent grill part 56 extended also from the control panel 50 to a top end of the microwave oven. The vent grill part 56 also has an upper part with reference to the vent holes 36' having a thickness smaller than a lower part thereof, to open the upper part. According to this, the vent grill part 56 has an opened top end, allowing communication between an inside and an outside of the microwave oven through the vent holes 36' in the front surface 34. A reference symbol 60 denotes an outer case forming an outer appearance of the microwave oven.

The operation of the foregoing microwave oven of the present invention will be explained. The vent grill parts 46 and 56 are formed on tops of the door 40 and the control panel 50 as one unit, respectively. The vent grill parts 46 and 56 cover the vent holes 36 and 36' in the front surface 34 from external view. However, the vent holes 36 and 36' can be seen at an angle from above the microwave oven, which state is illustrated in FIG. 4. Therefore, while the vent grill part 46 on top of the door 40 covers the vent holes 36 in the front surface 34 from frontal view, the vent grill part 46 permits air inside and outside of the microwave oven to communicate through the vent holes 36 as the vent grill part 46 is spaced from the vent holes 36. And, while the vent grill part 56 on top of the control panel 50 also covers the vent holes 36' in the front surface 34 from frontal view, the vent grill part 56 permits air inside and outside of the microwave oven to communicate through the vent holes 36' as the vent grill part 56 is spaced from the vent holes 36'. Therefore, as shown in FIG. 4, when food is cook in a state the door 40 is closed, ventilation of the air inside and outside of the microwave oven is made through the vent holes 36 and 36' and the opened top parts of the vent grill parts 46 and 56.

Thus, the present invention suggests to provide only a door and a control panel, without a separate vent grill in a front surface of the microwave oven, for making a front surface structure of the microwave oven simple different from in the related art in which a vent grill is provided separately, and an assembly process simple different from the related art in which a process for assembling the vent grill is required separately, thereby improving assembly process. Once the number of components for the front surface of the microwave oven is reduced, the front surface structure of the microwave oven is further simplified, the gaps between the frontal components are minimized, and minimize defective outer appearance caused by component assembly error of the microwave oven.

Figure 5:
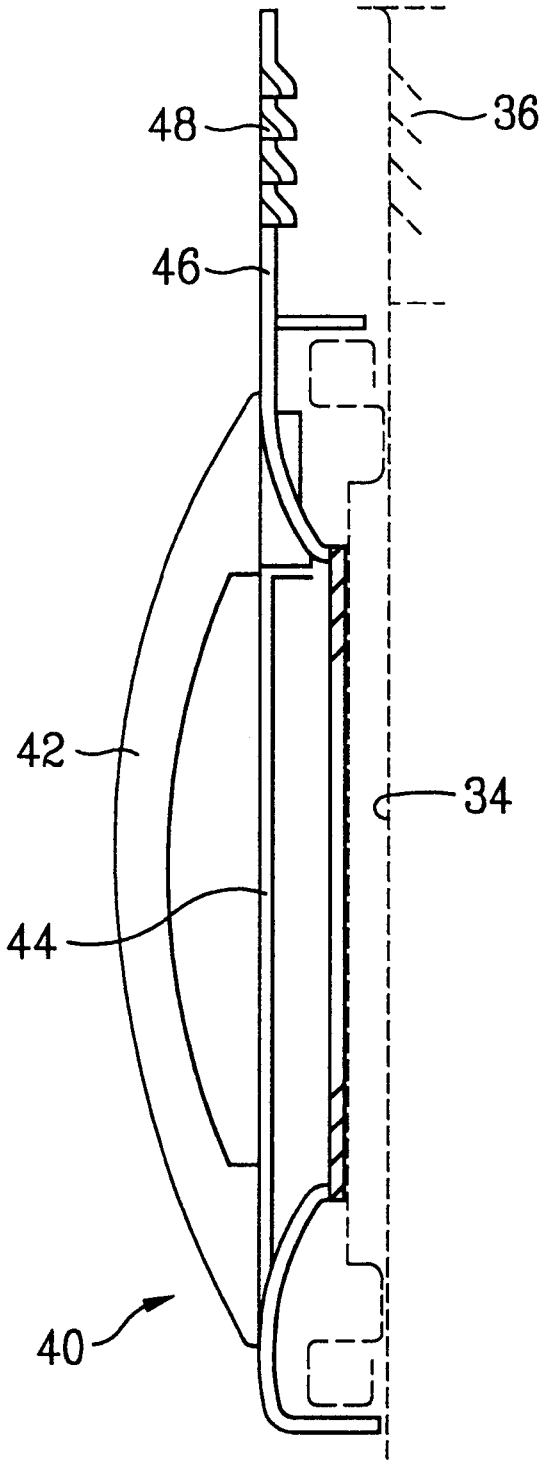

FIG. 5 illustrates a section of key parts of a microwave oven in accordance with another preferred embodiment of the present invention. As shown, there is a louver 48 on top of a vent grill part 46 formed as one unit with a door 40, so that the vent holes 36 in a front surface 34 of the main frame is in communication with a front part of the door 40. A top of the vent grill part 46 is also opened.

Thus, the embodiment permits communication between inside and outside of the microwave oven through the vent holes 36, the louver 48 in the vent grill part 46, and the opened top part, on the same time, for more smooth-air flow between inside/outside of the vent holes 36. Of course, a louver may be formed in the vent grill part 56 of the control panel 50, for air communication between inside/outside of the microwave oven through the ventilation hole 36'.

In the meantime, though not shown, as a variation of the embodiment of the present invention, the vent grill part may be formed at any one side of the door and the control panel. In other word, a position of the vent holes may be adjusted depending on a design condition, to form the vent grill part either of the door or the control panel.

As has been explained, the microwave oven of the present invention has the following advantages.

The formation of the vent grill as one unit with the door and the control panel for communication of air between inside and outside of the microwave oven, dispensing with a separate vent grill, minimizes a number of components of the front surface of the microwave oven, improves assembly work of the microwave oven, that drops a cost for the microwave open.

The minimized number of front surface components of the microwave oven in turn minimizes gaps between the components, prevents formation of gaps caused by assembly tolerances or distortion during use of the microwave oven, thereby improving a frontal outer appearance of the microwave oven.

The relatively simplified components improve assembly work, and drops a production cost.

It will be apparent to those skilled in the art that various modifications and variations can be made in the microwave oven of the present invention without departing from the spirit or scope of the invention. Thus, it is intended that the present invention cover the modifications and variations of this invention provided they come within the scope of the appended claims and their equivalents.

What is claimed is:

1. A microwave oven, comprising:

a main frame for both a cooking chamber and an electric fitting room and having a plurality of vent holes in an upper part of a front surface thereof;

a door attached to the front surface of the main frame for opening/closing the cooking chamber selectively;

a control panel attached to the front surface of the main frame in front of the electric fitting room; and a vent grill part formed as a single unit with the control panel so as to be spaced from vent holes in the front surface of the main frame for communicating air inside and outside of the microwave oven.

2. The microwave oven as claimed in claim 1, wherein the vent grill part has a thickness thinner than a lower part of the control panel and opens at a top end thereof.

3. The microwave oven as claimed in claim 1, wherein the vent holes are formed in an upper part of the electric fitting room in the front surface of the main frame.

4. The microwave oven as claimed in claim 1, wherein the vent grill part includes a louver at a position opposite to the vent holes in the upper part of the front surface of the main frame.

5. The microwave oven is claimed in claim 1, wherein the vent holes allow communication between air inside the electric fitting room and air outside the microwave oven.

6. A microwave oven, comprising:

a main frame having disposed therein a cooking chamber and an electric fitting room and having a plurality of vent holes in an upper portion of a front surface thereof;

a door attached to the front surface of the main frame and configured to be opened/closed to provide selective access to the cooking chamber; and a control panel attached to the front surface of the main frame and positioned in front of the electric fitting room, wherein the door and the control panel extend substantially to a top of the main frame forming a gap between the respective door or control panel and the front surface of the main frame, and wherein air inside and outside of the microwave oven communicates through the plurality of vent holes and the gap which opens to ambient air at the top of the front surface of the main frame.

7. The microwave oven as claimed in claim 6, wherein a top portion of the door is thinner than a remaining portion of the door, and a top portion of the control panel is thinner than a remaining portion of the control panel.

8. The microwave oven as claimed in claim 6, wherein the vent holes are formed at an upper portion of the cooking chamber and an upper portion of the electric fitting room in the front surface of the main frame.

9. The microwave oven as claimed in claim 6, further comprising a louver formed in the door and the control panel at a position opposite to the vent holes in the upper portion of the front surface of the main frame.

10. The microwave oven as claimed in claim 6, wherein the plurality of vent holes and the gap allow communication between air inside the cooking chamber and electric fitting room and air outside the microwave oven.

11. A microwave oven, comprising:

a main frame having disposed therein a cooking chamber and having a plurality of vent holes in an upper portion of a front surface thereof; and a door attached to the front surface of the main frame and configured to reciprocate between an open position and a closed position to provide selective access to the cooking chamber, wherein the door extends substantially to a top of the front surface of the main frame forming a gap between the door and the front surface of the main frame, and wherein air inside and outside of the microwave oven communicates through the pluarality of vent holes and the gap which opens to ambient air at the top of the front surface of the main frame.

12. The microwave oven as claimed in claim 11, wherein a top portion of the door is thinner than a remaining portion of the door.

13. The microwave oven as claimed in claim 11, wherein the vent holes are formed at an upper portion of the cooking chamber in the front surface of the main frame.

14. The microwave oven as claimed in claim 11, further comprising a louver formed in the door at a position opposite to the vent holes in the upper portion of the front surface of the main frame.

15. The microwave oven as claimed in claim 11, wherein the plurality, of vent holes and the gap allow communication between air inside cooking chamber and air outside the microwave oven.

16. A microwave oven, comprising:

a main frame having disposed therein an electric fitting room and having a plurality of vent holes in an upper portion of a front surface thereof; and a control panel attached to the front surface of the main frame in front of the electric fitting room, wherein the control panel extends substantially to a top of the front surface of the main frame forming a gap between the control panel and the main frame, and wherein air inside and outside of the microwave oven communicates through the pluarality of vent holes and the gap that opens to ambient air at the top of the front surface of the main frame.

17. The microwave oven as claimed in claim 16, wherein a top portion of the control panel is thinner than a remaining portion of the control panel.

18. The microwave oven as claimed in claim 16, wherein the vent holes are formed in an upper portion of the electric fitting room in the front surface of the main frame.

19. The microwave oven as claimed in claim 16, further comprising a louver formed in the control panel at a position opposite to the vent holes in the upper portion of the front surface of the main frame.

20. The microwave oven is claimed in claim 16, wherein the plurality of vent holes and the gap allow communication between air inside the electric fitting room and air outside the microwave oven.

21. A microwave oven, comprising:

a main frame for both a cooking chamber and an electric fitting room and having a plurality of vent holes in an upper part of a front surface thereof;

a door attached to the front surface of the main frame for opening/closing the cooking chamber selectively;

a control panel attached to the front surface of the main frame in front of the electric fitting room; and a vent grill part formed as a single unit with the door so as to be spaced from vent holes in the front surface of the main frame for communicating air inside and outside of the microwave oven.

* * * * *